US010139076B2

(12) United States Patent
Tan et al.

(10) Patent No.: US 10,139,076 B2
(45) Date of Patent: Nov. 27, 2018

(54) LIGHT EMITTING DIODE MODULE

(71) Applicants: CHAMP TECH OPTICAL (FOSHAN) CORPORATION, Foshan (CN); Foxconn Technology Co., Ltd., New Taipei (TW)

(72) Inventors: Cheng-Bing Tan, Foshan (CN); Wen Xu, Foshan (CN); Shih-Hsun Wung, New Taipei (TW)

(73) Assignee: CHAMP TECH OPTICAL (FOSHAN) CORPORATION, Foshan (CN)

( * ) Notice: Subject to any disclaimer, the term of this patent is extended or adjusted under 35 U.S.C. 154(b) by 429 days.

(21) Appl. No.: 14/880,665

(22) Filed: Oct. 12, 2015

(65) Prior Publication Data

US 2017/0059093 A1 Mar. 2, 2017

(30) Foreign Application Priority Data

Aug. 25, 2015 (CN) ..... 2015 1 0525683

(51) Int. Cl.

| | |
|---|---|
| ***F21V 3/02*** | (2006.01) |
| ***F21V 29/506*** | (2015.01) |
| ***F21K 9/232*** | (2016.01) |
| ***F21K 9/238*** | (2016.01) |
| ***F21K 9/69*** | (2016.01) |
| *F21V 17/12* | (2006.01) |
| *F21Y 105/10* | (2016.01) |

(52) U.S. Cl.

CPC ..... *F21V 3/02* (2013.01); *F21K 9/232* (2016.08); *F21K 9/238* (2016.08); *F21K 9/69* (2016.08); *F21V 29/506* (2015.01); *F21V 17/12* (2013.01); *F21Y 2105/10* (2016.08)

(58) Field of Classification Search

CPC . F21K 9/232; F21K 9/238; F21K 9/69; F21V 29/506; F21V 29/503; F21V 29/70; F21V 3/02

See application file for complete search history.

(56) References Cited

U.S. PATENT DOCUMENTS 6,864,513 B2 * 3/2005 Lin ..... F21V 29/004 257/712
8,282,249 B2 * 10/2012 Liang ..... F21K 9/232 362/249.02

(Continued)

FOREIGN PATENT DOCUMENTS

| | | | |
|---|---|---|---|
| CN | 201992399 | U | 9/2011 |
| CN | 104251394 | A | 12/2014 |
| CN | 204300962 | U | 4/2015 |

*Primary Examiner* — Robert May
*Assistant Examiner* — Leah S Macchiarolo
(74) *Attorney, Agent, or Firm* — ScienBiziP, P.C.

(57) ABSTRACT

A light emitting diode module (LED includes a base, a light emitting unit, a heat dissipation portion located between the base and the light emitting unit, a lens located on the heat dissipation portion to receive the light emitting unit therein. The heat dissipation portion includes a main portion, a first connecting portion and a second connecting portion respectively located on both ends of the main portion. A drive receives in a cavity defined collectively by the main portion, the first connecting portion and the second connecting portion. The drive element is coupled with the light emitting unit and the base, the drive element.

18 Claims, 9 Drawing Sheets

(56) References Cited

U.S. PATENT DOCUMENTS

| | | | | |
|---|---|---|---|---|
| 8,820,974 | B2 * | 9/2014 | Chang | F21V 3/02 362/249.02 |
| 2010/0265710 | A1 * | 10/2010 | Xiao | F21V 19/0055 362/249.02 |
| 2011/0133652 | A1 * | 6/2011 | Chen | F21V 19/001 315/112 |
| 2011/0170299 | A1 * | 7/2011 | Takase | F21V 3/00 362/308 |
| 2012/0326589 | A1 * | 12/2012 | Yu | F21V 3/02 313/46 |
| 2013/0077286 | A1 * | 3/2013 | Hu | F21V 23/002 362/85 |
| 2014/0036496 | A1 * | 2/2014 | Cai | G02B 19/0028 362/235 |
| 2016/0298826 | A1 * | 10/2016 | Lim | F21V 7/0091 |

* cited by examiner

LIGHT EMITTING DIODE MODULE

CROSS-REFERENCE TO RELATED APPLICATIONS

This application claims priority to Chinese Patent Application No. 201510525683.7 filed on Aug. 25, 2015, the contents of which are incorporated by reference herein.

FIELD

The subject matter herein generally relates to a light module, especially relates to a light emitting diode module.

BACKGROUND

Generally a light emitting diode (LED) lamp includes a lamp holder, an LED module mounted on the lamp holder and a lampshade covering the LED module therein. The LED module includes a plurality of LEDs arranged on a circuit.

BRIEF DESCRIPTION OF THE DRAWINGS

Implementations of the present technology will now be described, by way of example only, with reference to the attached figures.

FIG. 4 is a diagrammatic view of light path in a lens of an LED module in.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure. The description is not to be considered as limiting the scope of the embodiments described herein.

Several definitions that apply throughout this disclosure will now be presented. The term "comprising" means "including, but not necessarily limited to"; it specifically indicates open-ended inclusion or membership in a so-described combination, group, series and the like. The term "coupled" is defined as connected, whether directly or indirectly through intervening components, and is not necessarily limited to physical connections. The connection can be such that the objects are permanently connected or releasably connected.

Figure 1:
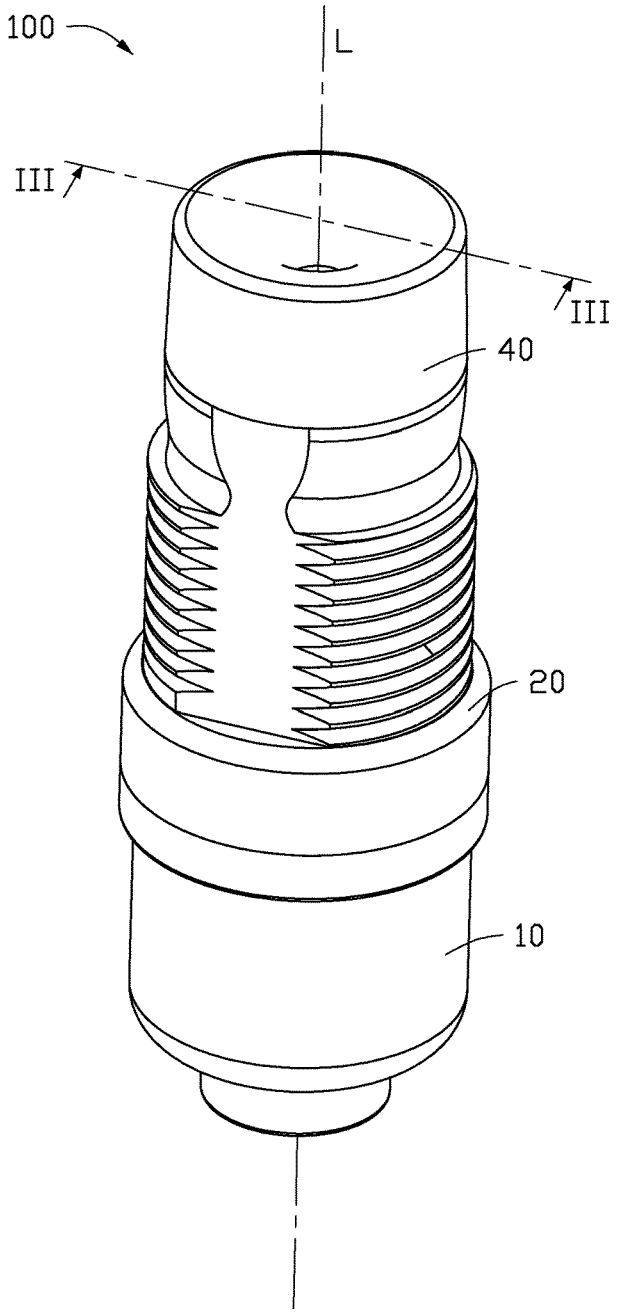
FIG. 1 is an assembled, isometric view of an LED module in accordance with a first embodiment of the present disclosure.
Figure 2:
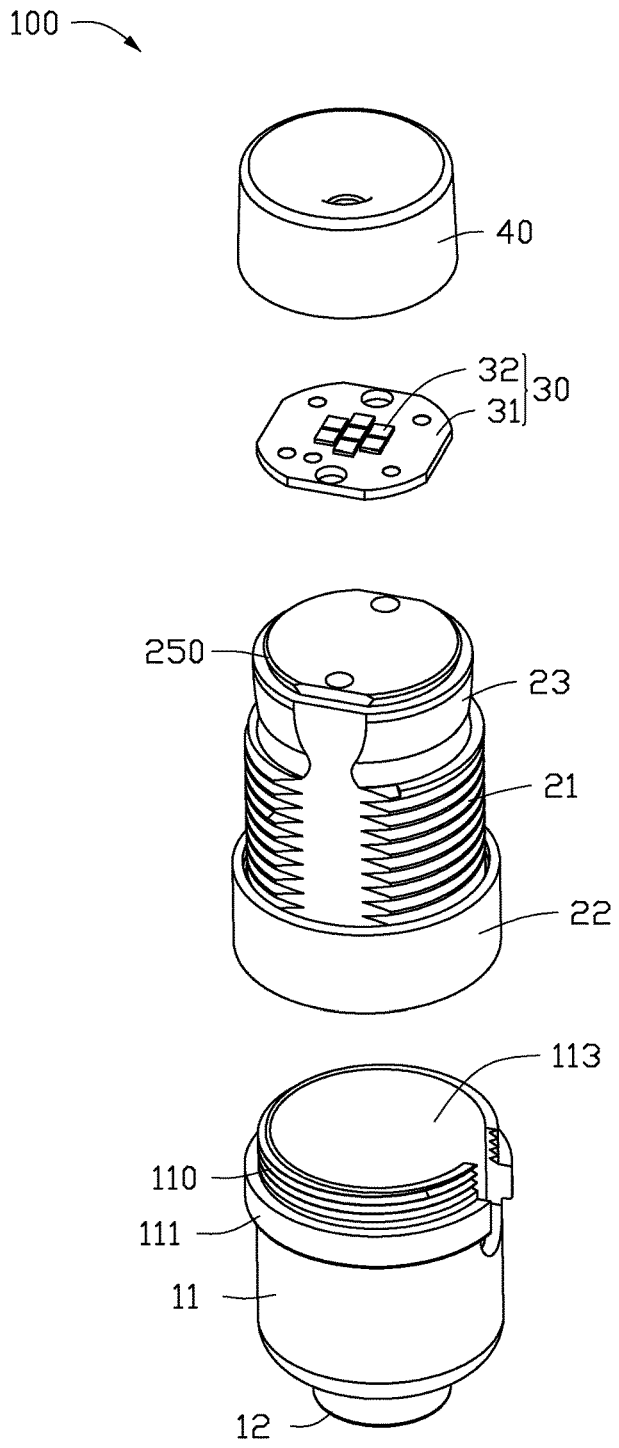
FIG. 2 is an exploded, isometric view of the LED module of FIG. 1.

As illustrated in FIGS. 1-2, a light emitting diode (LED) module 100 of a first embodiment includes a base 10, a light emitting unit 30, a heat dissipation portion 20 located between the base 10 and the light emitting unit 30, a lens 40 located on the heat dissipation portion 20. The LED module 100 has an axis L. The base 10, the heat dissipation 20, the light emitting unit 30 and the lens 40 are symmetric about the axis L.

The base 10 presents a cylinder, and includes a body 11 and a coupling portion 12 extending downwardly from an end of the body 11. The body 11 and the coupling portion 12 can be cylinder-shaped. A diameter of the body 11 is less than that of the coupling portion 12. The coupling portion 12 is configured to couple with electrical device (not shown). An end of the body 11 opposite to the coupling portion 12 connects to the heat dissipation portion 20. In the illustrated embodiment, the base 10 is fixed on the heat dissipation portion 20 by threaded connections. Specifically, an outer surface of the end of the body 11 opposite to the coupling portion 12 forms a screw portion 110 and a retaining ring 111 neighboring to the screw portion 110. The screw portion 110 includes a plurality of screw thread around the outer surface of the end of the body 11. The retaining ring 111 is a circular ring that surrounds the outer surface of the body 11. A diameter of the retaining ring 111 is larger than that of the body 11. The end of the body 11 close to the heat dissipation portion 20 forms an adapter plate 113 configured to couple with a drive element 50 received in the heat dissipation portion 20.

Figure 3:
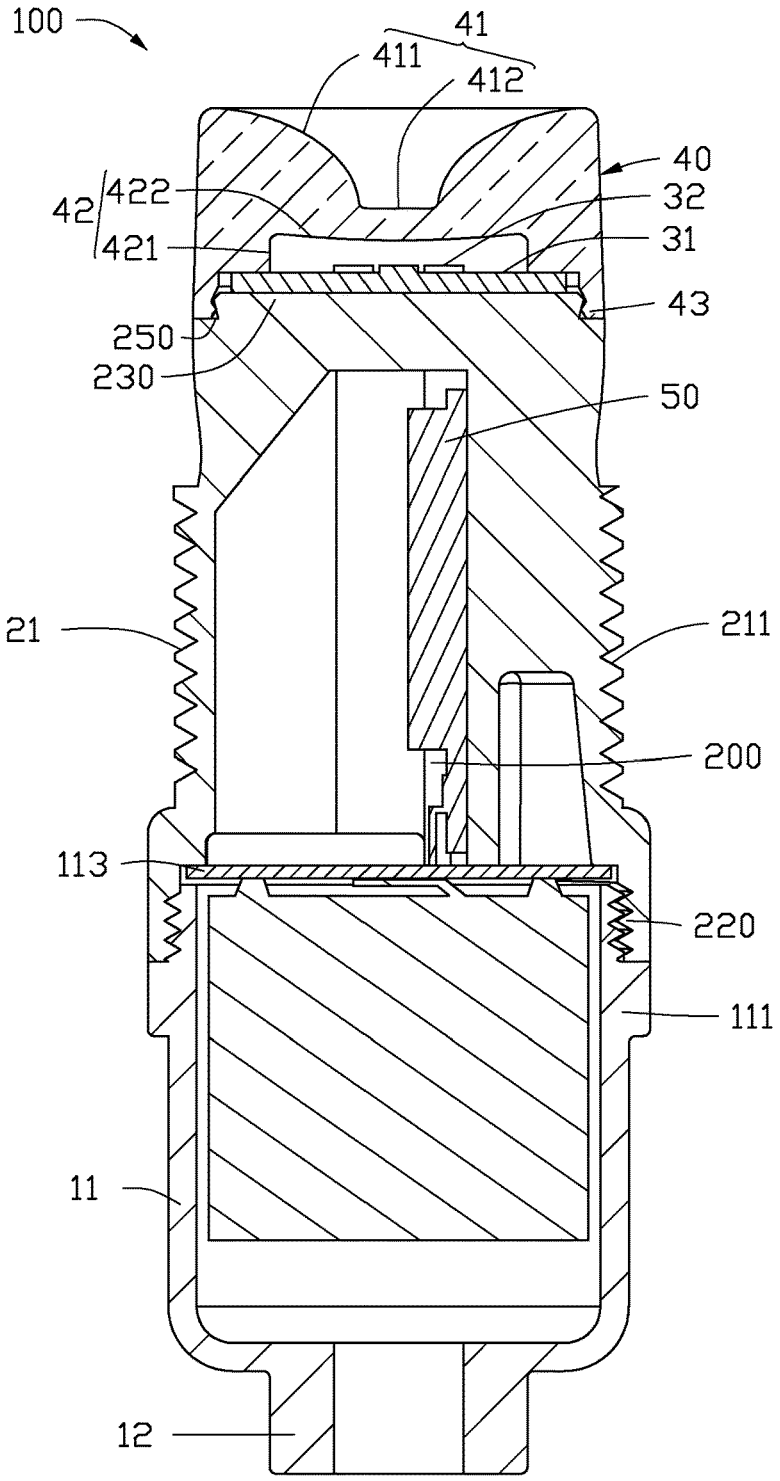
FIG. 3 is a cross sectional view of the LED module of the FIG. 1, taken along III-III line.

Also referring to FIG. 3, the heat dissipation portion 20 present a multilayer cylinder stacked together with different diameters. The heat dissipation portion 20 includes a main portion 21, a first connecting portion 22 and a second connecting portion 23 respectively located on both ends of the main portion 21. An outer diameter of the first connecting portion 22 is equal to the diameter of the retaining ring 111, and is larger than a diameter of the main portion 21. The diameter of the main portion 21 is greater than that of the second connecting portion 23. The drive element 50 is received in a cavity 200 defined collectively by the main portion 21, a first connecting portion 22 and the second connecting portion 23. The drive element 50 is coupled with the adapter plate 113 and the light emitting unit 30.

The main portion 21 forms a plurality of cooling channels 211 around the outer surface thereof. In the illustrated embodiment, the cooling channels 211 can be screw thread. A cross section of the cooling channels is zigzag shaped.

The first connecting portion 22 extends from a bottom end of the main portion 21 and surrounds the main portion 21. An inner surface of the first connecting portion 22 forms a plurality of screw threads 220 cooperating with the screw portion 110. The base 10 is fixed on the heat dissipation portion 20 by the screw thread 220 cooperating with the screw portion 110 of the base 10. While the base 10 is fixed on the heat dissipation portion 20, a bottom end of the first connecting portion 21 abuts against an top end of the retaining ring 111.

The second connecting portion 23 protrudes upwardly from a top end thereof to form a supporting portion 230. In the illustrated embodiment, the supporting portion 230 is a frustum-shaped. A diameter of the supporting portion 230 gradually increases from an end of the second connecting portion 23. A diameter of a top surface of the supporting portion 230 is less than the diameter of the second connecting portion 23. An outer periphery of the supporting portion 230 and the top end of the second connecting portion 23 collectively define a ladder 250, the ladder 250 is a groove. The ladder 250 is configured to fix the lens 40 on the heat dissipation portion 20.

The light emitting unit 30 is located on the supporting portion 230 of the second connecting portion 23. The light emitting unit 30 includes a circuit 31 and a plurality of LEDs 32 mounted on the circuit 31. The LEDs 32 are coupled with the drive element 50 by the circuit 31. In the illustrated embodiment, the number of the LED 32 is seven, the LEDs 32 are arranged on a center of the circuit 31 by a way of two-three-two pattern.

The lens 40 is located on the top end of the second connecting portion 23 to cover the light emitting unit 30 therein. The lens 40 has a first concave cavity 41 and a second concave cavity 42. The first concave cavity 41 is recessed from an edge of a top of the lens 40 towards a center of a bottom thereof. The second concave cavity 42 is recessed from a center of the bottom towards the top of the lens 40. A cross section of the first concave cavity 41 is groove-shaped, a cross section of the second concave cavity 42 is rectangular. The first concave cavity 41 includes a first side wall 411 and a bottom wall 412 connecting at bottom of the first side wall 411. The first side wall 411 is arc-shaped around the bottom wall 412 and protrudes towards the top of the lens 40. The bottom wall 412 is parallel to the supporting portion 230 of the second connecting portion 23. The second concave cavity 42 includes a second side wall 421 and a top wall 422 connecting with the second side wall 421. The second side wall 421 is a vertical surface surrounding the LEDs 32, the top wall 422 is curved surface. The top wall 422 protrudes towards the LEDs 32. A curvature of the first side wall 411 is greater than that of the top wall 422.

The lens 40 further extends downwardly from a bottom periphery edge thereof to form a buckle 43. The buckle 43 cooperates with the ladder 250 to fix the lens 40 onto the heat dissipation portion 20. The circuit 31 of the light emitting unit 30 is located between the bottom of the buckle 43 and the supporting portion 230. The LEDs 32 of the light emitting unit 30 is received in the second concave cavity 42.

Figure 4:
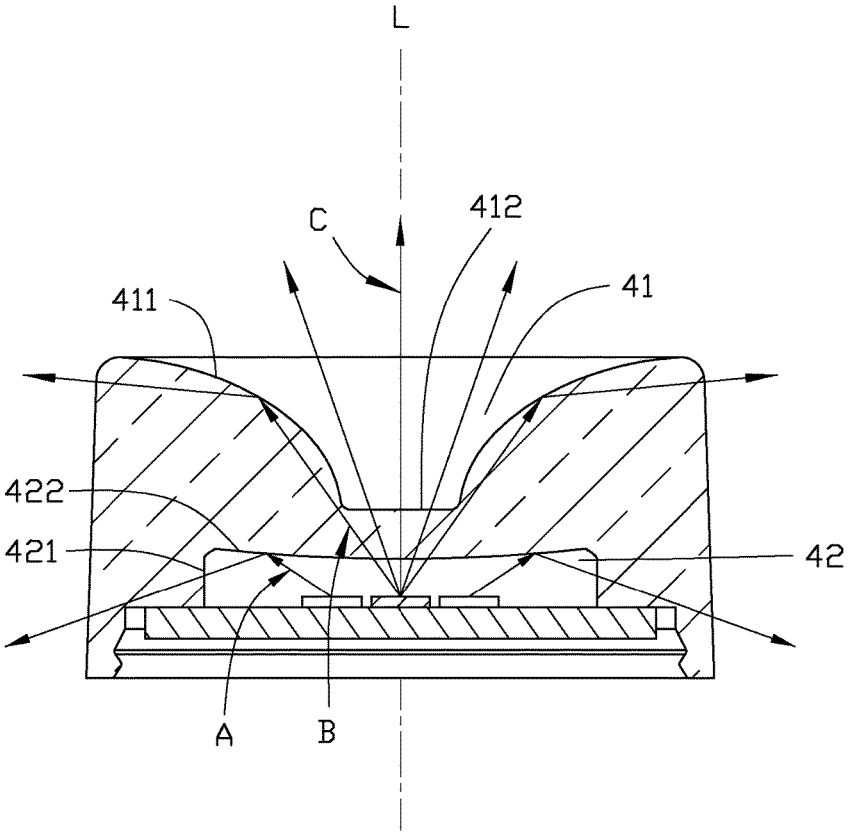

As illustrated in the FIG. 4, a first light A emitted from the LEDs 32 is reflected by the top wall 422 of the second concave cavity 42 to exit towards the second side wall 421; a second light B emitted from the LEDs 32 is reflected by the first side wall 411 of the first concave cavity 41 to exit from a periphery of the lens 40; a third light C emitted from the LEDs 32 enters the lens 40 and exits directly from the second side wall 412 of the first concave cavity 41. First light A, second light B and third light C emitted from the LEDs 32 of the light emitting unit 30 satisfies following relations: a light outputting angle defined between first light A and the axis L is larger than a light outputting angle defined between the second light B and the axis L; the outputting angle defined between the second light B and the axis L is larger than a light outputting angle defined between the third light C and the axis L. As light emitted from the LEDs 32 and exiting around the periphery of the lens 40 is increased, light exiting along the axis L is decreased.

While the LED module 100 is assembled, the heat dissipation portion 20 is fixed on the base 10 by the first connecting portion 22 cooperating with the screw portion 110, the lens 40 is fixed on the heat dissipation portion 20 by the ladder 250 cooperating with the buckle 43. The derive element 50 is received in the heat dissipation portion 20 to couple with the light emitting unit 30 and the adapter plate 113. The LED module 100 is coupled to electrical device by the base 10.

Figure 5:
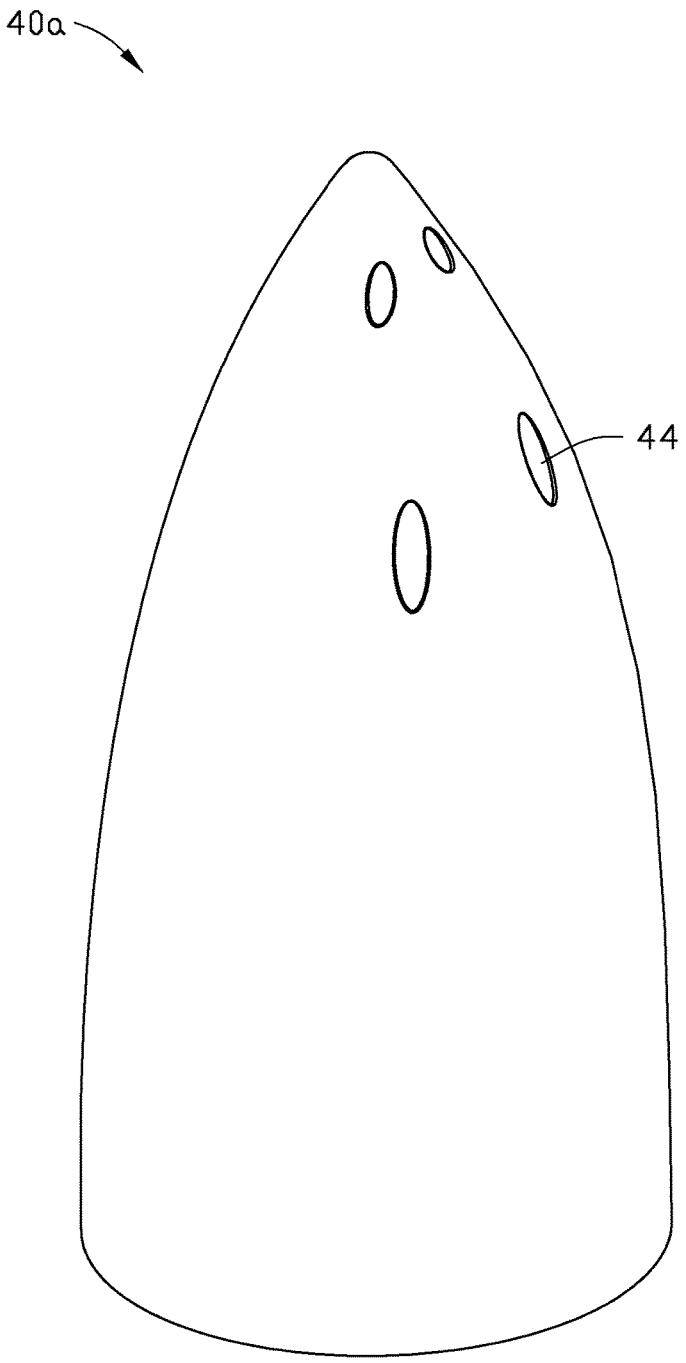
FIG. 5 is isometric view of a lens of the LED module in accordance with a second embodiment of the present disclosure.

Referring to FIG. 5, a lens 40*a* of a second embodiment of the present disclosure is candle-shaped. A plurality of through holes 44 presented ellipse-shaped are formed on the surface of the lens 40. Heat generated from the light emitting unit 30 can be dissipated through the through holes 44 of the lens 40*a* to outside. Further, light emitted from the light emitting unit 30 exits through the through holes 44 with a pattern corresponding to the through hole 44 of the lens 40*a*.

Figure 6:
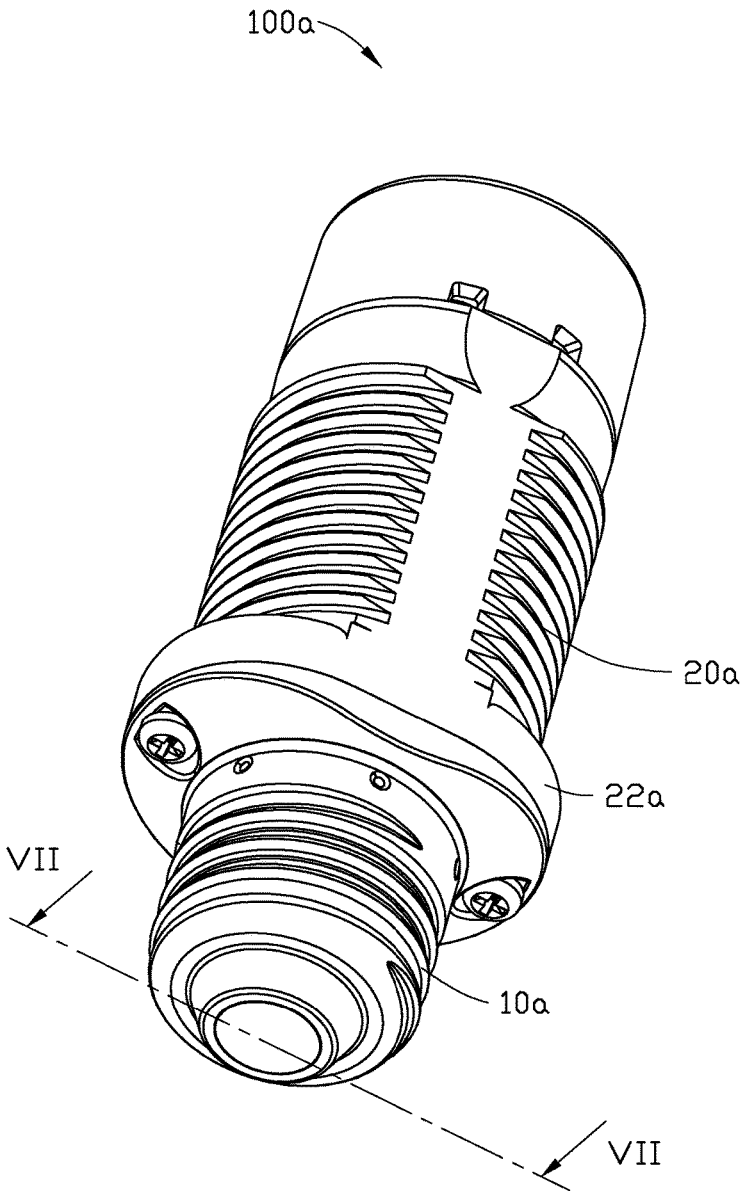
FIG. 6 is an assembled view of an LED module in accordance with a third embodiment of the present disclosure.
Figure 7:
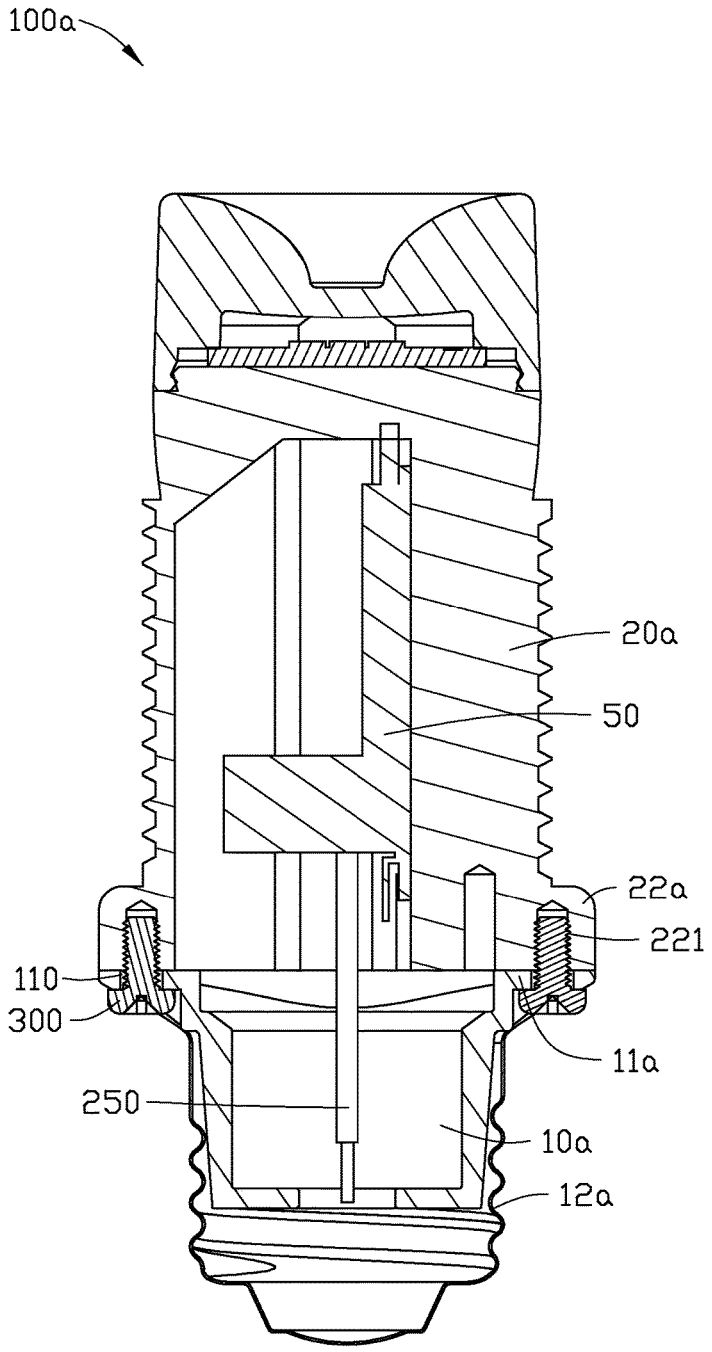
FIG. 7 is a cross sectional view of the LED module of FIG. 6, taken along VII-VII line.

Referring to FIGS. 6-7, an LED module 100*a* of a third embodiment of the present disclosure is similar to the LED module 100. A base 10*a* of the LED module 100*a* includes an body 11*a* and a coupling portion 12*a* extending from an end of the body ha. A periphery of the body 11*a* forms a plurality of through holes 110. A bottom of a first connecting portion 22*a* forms a plurality of connection hole 221 corresponding to the through holes 110.

While the base 10*a* is fixed on the heat dissipation portion 20*a*, each through hole 110 of the base 10*a* aims at a corresponding connection hole 221 of the first connecting portion 22*a*, a screw 300 traverses the through hole 110 to screw on the connection hole 221 to fix the base 10*a* onto the heat dissipation portion 20*a*. The drive element 50 is coupled with the base 10*a* by a wire 250.

Figure 8:
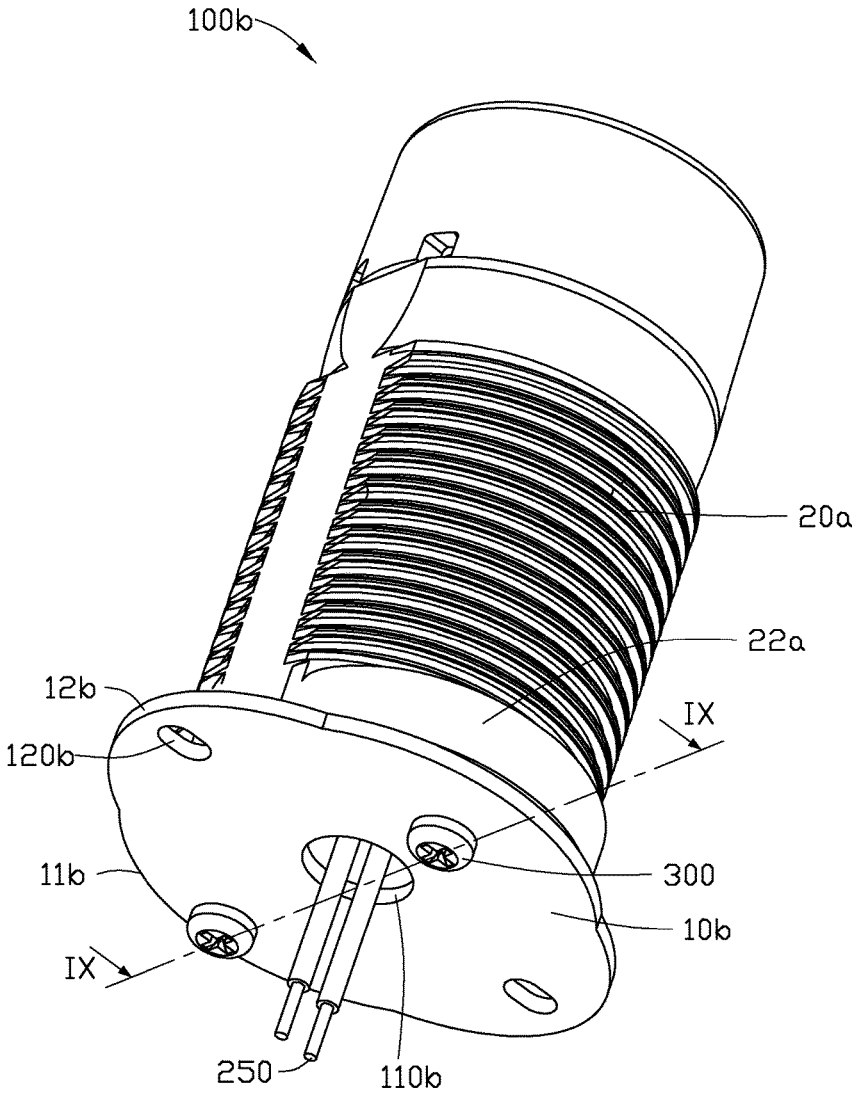
FIG. 8 is an assembled view of an LED module in accordance with a fourth embodiment of the present disclosure.
Figure 9:
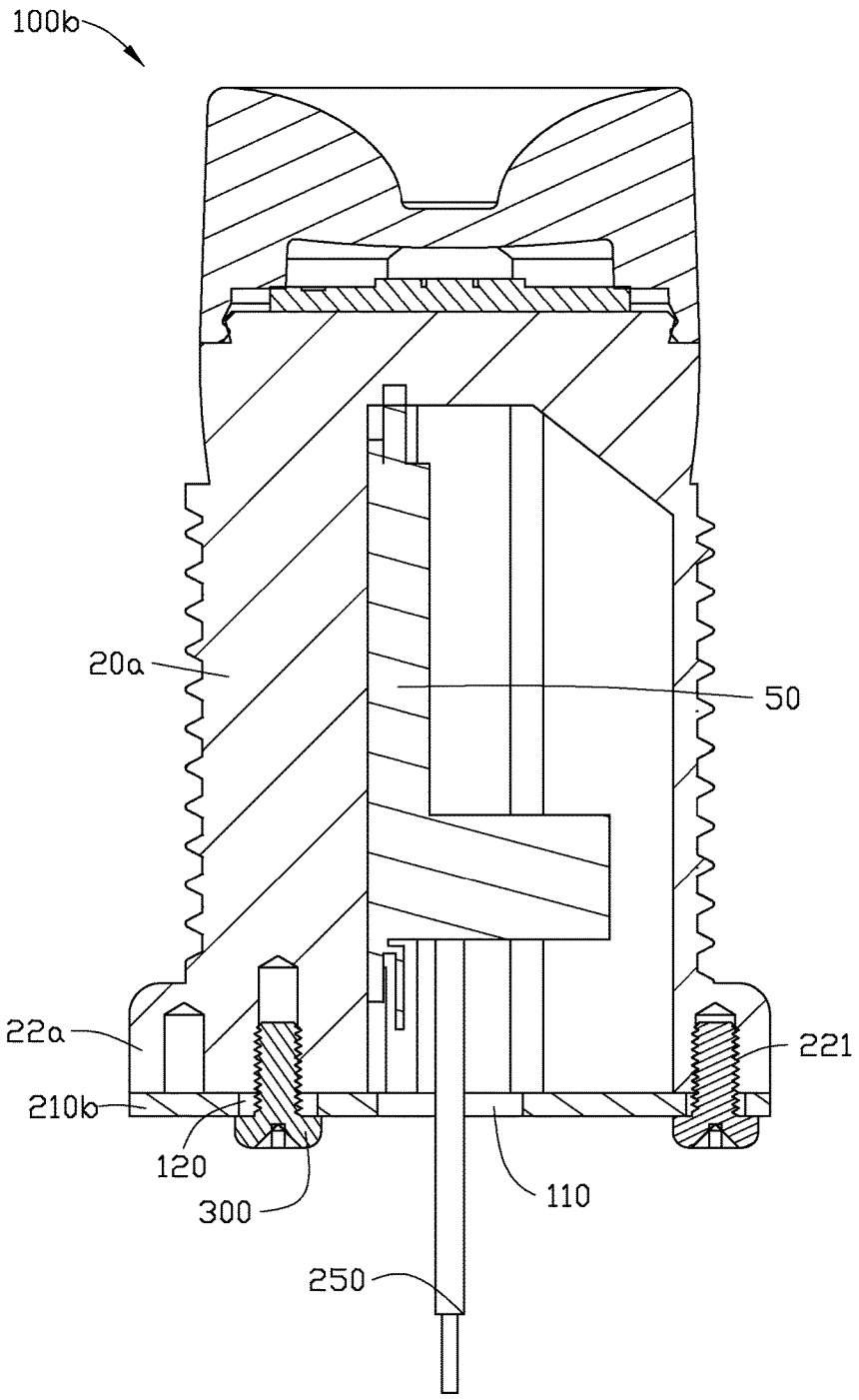
FIG. 9 is a cross sectional view of the LED module of FIG. 8, taken along IX-IX line.

Referring to FIGS. 8-9, an LED module 100*b* of a fourth embodiment of the present disclosure is similar to the LED module 100*a* of the third embodiment. Specifically, the base 10*b* presents a planar plate. The base 10*b* includes an body 11*b* and a coupling portion 12*b* extending from both opposite ends of the body 11*b*. A center of the body 11*b* defines a through hole 110*b* and two first fixed holes 120 around a periphery of the through hole 110*b*. Two second fixed hole 120*b* are formed on the coupling portion 12*b*.

While the base 10*b* is fixed on the heat dissipation portion 20*a*, the first fixed hole 120 of the body 11*b* aims at the connecting hole 221 of the first connecting portion 22*a*, the screw 300 is through the first fixed hole 120 and the connecting hole 221 to fix the base 10*b* on the heat dissipation portion 20*a*. The second fixed hole 120*b* of the coupling portion 20*a* is exposed outside of the first connecting portion 22*a* to connect a electrical device. The wire 250 coupled with the derive element 50 is exposed from the through hole 110*b* to couple to electrical device.

The embodiments shown and described above are only examples. Many details are often found in the art such as the other features of the LED module. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, including in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A light emitting diode (LED) module, comprising:
a base;
a heat dissipation portion located between the base and a light emitting unit, the heat dissipation portion comprising:
a main portion having a first end and a second end opposite the first end;
a first connecting portion located at the first end of the main portion;
a second connecting portion located at the second end of the main portion;
a lens configured to receive the light emitting unit therein, and being embedded in the second connecting portion;
a drive element receiving in a cavity defined collectively by the main portion, the first connecting portion and the second connecting portion, and the drive element coupling with the light emitting unit and the base;
wherein the base being fixed on the first connecting portion of the heat dissipation by screw connection, the second connecting portion protrudes upwardly from a top end thereof to form a supporting portion, the supporting portion is frustum-shaped, a diameter of the supporting portion gradually increases in a direction away from an end of the second connecting portion, a diameter of a top end of the supporting portion is less than the top end of the second connecting portion.

2. The LED module of claim 1, wherein an outer periphery of the supporting portion and the top end of the of the second connecting portion collectively define a groove.

3. The LED module of claim 2, wherein the lens has a first concave cavity and a second concave cavity, the first concave cavity is recessed from an edge of a top of the lens towards a center of a bottom thereof, the second concave cavity is recessed from a center of the bottom towards the top of the lens.

4. The LED module of claim 3, wherein the first concave cavity comprises a first side wall and a bottom wall connecting at bottom of the first side wall, the first side wall is arc-shaped around the bottom wall and protrudes towards the top of the lens.

5. The LED module of claim 4, wherein the bottom wall is substantially parallel to the supporting portion of the second connecting portion.

6. The LED module of claim 4, wherein the second concave cavity comprises a second side wall and a top wall connecting with the second side wall, the second side wall is a vertical surface surrounding the LEDs, and the top wall is a curved surface protruded towards the LEDs.

7. The LED module of claim 6, wherein a curvature of the first side wall is greater than that of the top wall.

8. The LED module of claim 3, wherein the lens further extends downwardly from a bottom periphery edge thereof to form a buckle, the buckle cooperates with the ladder to fix the lens on the heat dissipation portion.

9. The LED module of claim 1, wherein first connecting portion extends from a bottom end of the main portion and surrounds the main portion, an inner surface of the first connecting portion forms the screw threads.

10. The LED module of claim 9, wherein the base comprises an body and a coupling portion extending downwardly from an end of the body, an outer surface of the end of the body opposite to the coupling portion forms a screw portion to cooperate with the screw thread of the first connecting portion.

11. The LED module of claim 10, wherein a retaining ring is formed around the outer surface of the body and is close to the screw portion, an outer diameter of the first connecting portion is equal to a diameter of the retaining ring, and larger than a diameter of the main portion.

12. The LED module of claim 11, wherein the bottom end of the first connecting portion abuts against an top end of the retain ring.

13. A light emitting diode (LED) module, comprising:
a base;
a light emitting unit;
a heat dissipation portion located between the base and the light emitting unit, the heat dissipation comprising:
a main portion;
a first connecting portion, and a second connecting portion respectively located on both ends of the main portion;
a lens located on the heat dissipation portion to receive the light emitting unit therein, the lens being embedded in the second connecting portion to fix on the heat dissipation portion, the base being fixed on the first connecting portion of the heat dissipation by a screw;
a drive element receiving in a cavity defined collectively by the main portion, the first connecting portion and the second connecting portion, and the drive element coupling with the light emitting unit and the base,
wherein the second connecting portion protrudes upwardly from a top end thereof to form a supporting portion, the supporting portion is frustum-shaped, a diameter of the supporting portion gradually increases in a direction away from an end of the second connecting portion, a diameter of a top end of the supporting portion is less than the top end of the second connecting portion.

14. The LED module of claim 13, wherein the base comprises a body and a coupling portion extending from an end of the body, a periphery of the body forms a plurality of through holes.

15. The LED module of claim 14, wherein a bottom of a first connecting portion forms a plurality of connection holes corresponding to the through holes.

16. The LED module of claim 13, wherein the drive element is coupled with the base by a wire.

17. The LED module of claim 13 wherein the base presents a planar plate, and comprises a body and a coupling portion extending from both opposite ends of the body, a center of the body defines a through hole and two first fixed holes around a periphery of the through hole.

18. The LED module of claim 17 wherein the second fixed holes are formed on the coupling portion.

* * * * *